US009504931B1

(12) United States Patent
Harris, Sr.

(10) Patent No.: US 9,504,931 B1
(45) Date of Patent: Nov. 29, 2016

(54) TOY SIMULATOR

(71) Applicant: Allen R. Harris, Sr., Portsmouth, VA (US)

(72) Inventor: Allen R. Harris, Sr., Portsmouth, VA (US)

( * ) Notice: Subject to any disclaimer, the term of this patent is extended or adjusted under 35 U.S.C. 154(b) by 0 days.

(21) Appl. No.: 14/868,613

(22) Filed: Sep. 29, 2015

(51) Int. Cl.
*A63H 33/00* (2006.01)
*A63H 33/30* (2006.01)

(52) U.S. Cl.
CPC ..... *A63H 33/3033* (2013.01)

(58) Field of Classification Search
USPC ..... 446/7, 26, 28, 71, 230, 231; 434/29, 62, 434/69, 71
See application file for complete search history.

(56) References Cited

U.S. PATENT DOCUMENTS

D87,118 S 6/1932 Knopf
2,100,245 A * 11/1937 Fagan ..... A63G 17/00 224/259
2,738,974 A * 3/1956 Vincent ..... A63G 17/00 446/28
2,836,008 A 5/1958 Nichols
2,864,613 A * 12/1958 Porter ..... A63H 33/00 116/215
D189,098 S 10/1960 Kreienbrink
D189,484 S 12/1960 Ramniceanu
3,010,718 A 11/1961 Pearson, Jr.
3,178,851 A 4/1965 Gage
3,186,124 A 6/1965 Voss
3,563,550 A * 2/1971 Saunder ..... A63F 7/044 273/113
3,608,234 A * 9/1971 Davidson ..... A63H 33/00 446/28
3,715,832 A 2/1973 Torres
4,043,075 A 8/1977 Breneman
4,717,365 A 1/1988 Andersen et al.
4,850,922 A 7/1989 Harris
5,316,515 A * 5/1994 Hyman ..... A63H 33/00 446/26
7,311,578 B2 * 12/2007 Stanley ..... A63H 33/006 446/230
2009/0280715 A1 * 11/2009 Palmeiri ..... A63J 7/005 446/28

* cited by examiner

*Primary Examiner* — Kurt Fernstrom
(74) *Attorney, Agent, or Firm* — Thomas & Karceski, P.C.

(57) ABSTRACT

A toy simulator includes a semi-rigid base that is adapted to be releaseably attached and worn by a child on the front torso of a child. An action arm is connected to the semi-rigid base and includes multiple ranges of motion that allow a child substantial movement of various components of the toy simulator in order to provide multiple layers of movement and imagination for the child.

8 Claims, 5 Drawing Sheets

TOY SIMULATOR

The field of the invention is toys, and more particularly described a toy capable of manipulation by a child in a manner to simulate the operation of a vehicle such as a car or airplane.

BACKGROUND

Child's toys in the form, for instance, of model cars and airplanes are well known. Such toys can be held by a child while walking or running and manipulated to simulate the motions of an actual car or airplane. There also exist large toy structures, including toy airplane structures, that are worn by a child and manipulated while walking or running. Although the toys that are worn give a more realistic feeling of controlling the flight of an airplane, for instance, they are cumbersome and generally do not provide more than one or two modes of manipulative motion. The relatively large size and fixed construction of earlier worn airplane toys generally thwarted variations in appearance, thereby restricting the versatility and appeal of the toy.

Video games are also well known in the field of automobile and airplane flight simulation. The problem with these and any other video games is the lack of physical exercise by a child. Additionally, the video game or simulator inevitably limits a child's imagination to the content of that video game or simulator.

A flight simulating toy is disclosed in U.S. Pat. No. 4,850,922. However, this toy has a limited number of relative movements of the parts in that toy.

SUMMARY

Accordingly, it is an object of the present invention to overcome the restrictions and limitations of prior art toy systems. The present toy provides multiple moving parts that may be manipulated by a child during running or walking.

In one example, a toy simulator comprises a harness strap and a semi-rigid base attached to the harness strap. The semi-rigid base is adapted to be disposed in front of a child and above waist level. The harness strap has an adjustable effective length to encircle the shoulders of the child and retain the base in front of the child. The semi-rigid base has a rack of a plurality of parallel and horizontal grooves on a front face of the semi-rigid base. An action arm has a lower proximal end thereof that is slidably engaged with the semi-rigid base and rack thereon. The proximal end of the action arm further comprises a tab that is biased against the face of the rack and its grooves, wherein the tab is stiff enough to retain the action arm in a vertical location on the rack but flexible enough to allow a child to move the action arm up and down the face of the rack and rigid base. The action arm may further comprise a main spring that enables forward and back rotation of the action arm pivoting around the main spring that is positioned near the proximal end of the action arm. The axis of rotation of the action arm is substantially parallel to the horizontal grooves on the front face of the rack. The main spring may be biased to the upright position where the length of the action arm is substantially parallel to the face of the semi-rigid base. The toy may further comprise an interchangeable toy mount that is connected to substantially the distal end of the action arm, wherein the mount comprises a rotatable connector for receiving an interactive toy handle. The toy mount may comprise a stem that is slidably engaged in a sleeve in the distal end of the action arm such that the toy mount is moveable into and out from the action arm sleeve generally along a longitudinal axis of the action arm. The toy handle may simulate a vehicle steering wheel or an airplane steering wheel. The stem and sleeve may be frictionally engaged with each other by way of grooves formed in a face of the stem and a ball and spring mechanism in the sleeve bearing against the stem grooves. The toy mount may be rotatably mounted onto the stem such that the axis of rotation of the toy mount is substantially perpendicular to the longitudinal axis of the action arm.

DETAILED DESCRIPTION

Figure 1:
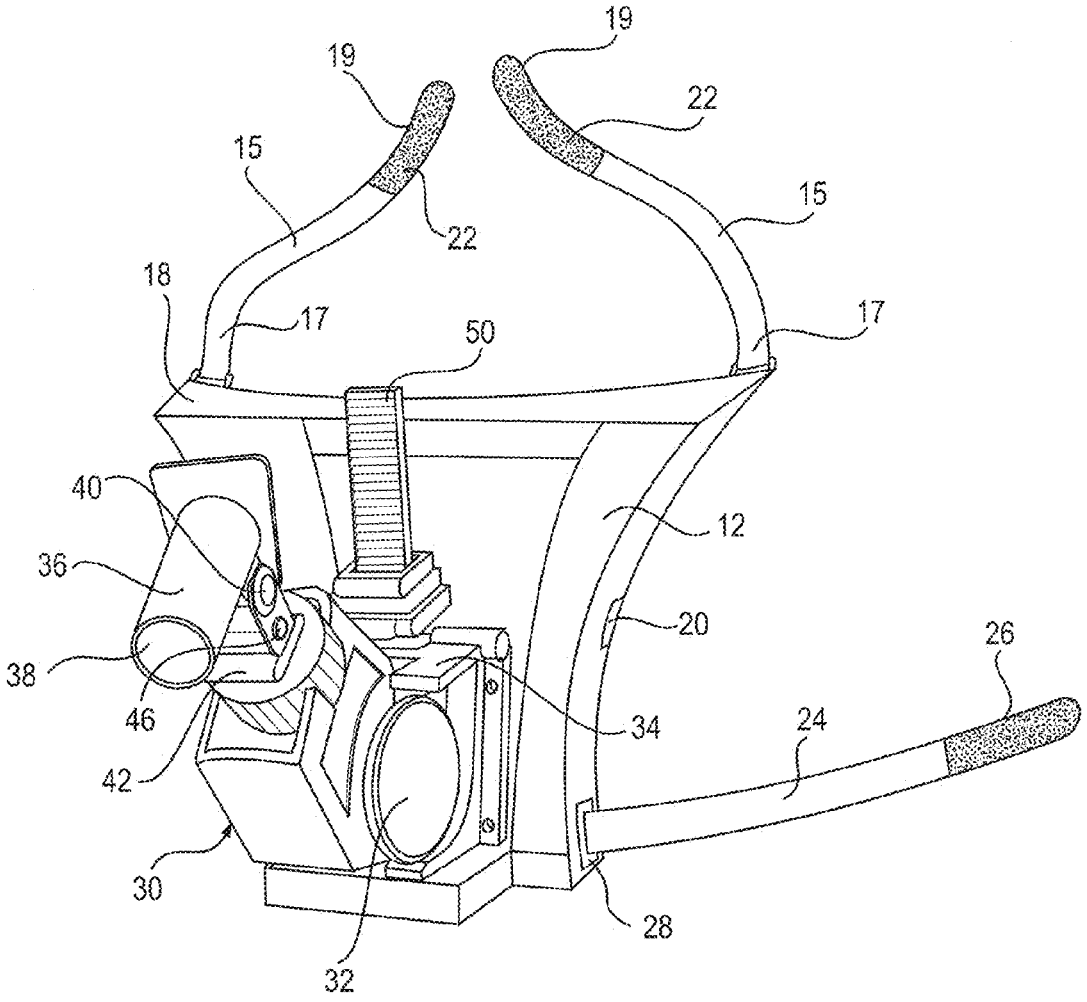
FIG. 1 is a perspective view of a toy simulator as described herein.

The toy simulator as described herein includes multiple ranges of motion. These ranges include both linear and rotational movement. The toy simulator provides a child user with many options for movement including combinations of movements. Ideally, the multiple ranges of motion enable a broad range of imagination and play simulation. Moreover, the simulator may accommodate movements with other devices including electronics devices.

Turning now to FIGS. 1-4, there is shown an example of a toy simulator. The toy simulator includes a semi-rigid base 12 that is adapted to abut against the body of the child who wears the toy. Paired shoulder straps 15 are attached at their proximal extremities 17 to the base 12. The semi-rigid 12 base is contoured so as to fit comfortably against a child's chest. The distal extremities 19 of straps 15 are provided with hook and loop attachment material 22 and are adapted to be inserted through slots 20 on opposite sides of the semi-rigid base 12. When the distal extremities 19 are inserted into the slots 20, they are folded upon themselves to achieve releasable securement by virtue of the hook and loop fastener material. There is also a waist strap 24 that is joined at its proximal extremity 28 to the semi-rigid base 12. The distal extremity 26 of the waist strap 24 is provided with hook and loop fastener attachment material and is adapted to be inserted into a slot and releaseably attached around a slot on the opposite side of the semi-rigid base 12 from the proximal extremity 28 of the waist strap 24. Of course the straps discussed herein may be attached around a user by deploying other types of fasteners including, but not limited to, snaps and buttons.

The semi-rigid base 12 has a rack 50 mounted thereon. The rack 50 has a plurality of parallel and horizontal grooves on the front face thereof. This rack 50 is mounted in a vertical orientation on the front face of the semi-rigid base 12. An action arm 30 is mounted onto a carriage 34 at a lower, proximal end of the action arm 30. The carriage 34 is slidably engaged with the semi-rigid base 12 through engagement of the rack 50 thereon. The carriage 34 on the proximal end of the action arm 30 further includes a tab 52 that is biased against the face of the rack 50 and the grooves therein. The tab 52 is stiff enough to retain the carriage 34 and therefore the action arm 30 in a vertical location on the rack 50. The tab 52 engages the rack 50 by a friction fit so that the carriage 34 may be relatively easily moved up and down by a child and retain its position when released.

The action arm 30 is connected to the carriage 34 and the semi-rigid base 12 by way of a main spring 32. The main spring 32 enables forward and back rotation of the action arm 30 pivoting around the axis of the main spring 32. The main spring is positioned near the proximal end of the action arm 30, and the axis of rotation of the action arm 30 around the main spring 32 is substantially parallel to the horizontal grooves on the front fact of the rack 50. The main spring 32 is biased so that the action arm 30 is in the upright position where the length of the action arm is substantially parallel to the face of the semi-rigid base 12. The action arm 30 further includes a stem 42 that supports a toy mount 36 at the distal end of the action arm. The mount 36 includes a tubular cavity 38 therein that acts as a connector for receiving an interactive toy handle 72. The toy handle 72 is a round tubular component that rotatably mounts within the cavity 38 of the mount 36. The mount 36 is also connected by way of hinge 46 to the stem 42. Connector bolt 40 may fixed and non-rotatable for safety and stability, or alternatively, in could also be adapted to be rotatable like hinge 46. If bolt 40 acts as a hinge, then each hinge 40 and 46 offers an additional range of motion of the toy handle 70.

Figure 2:
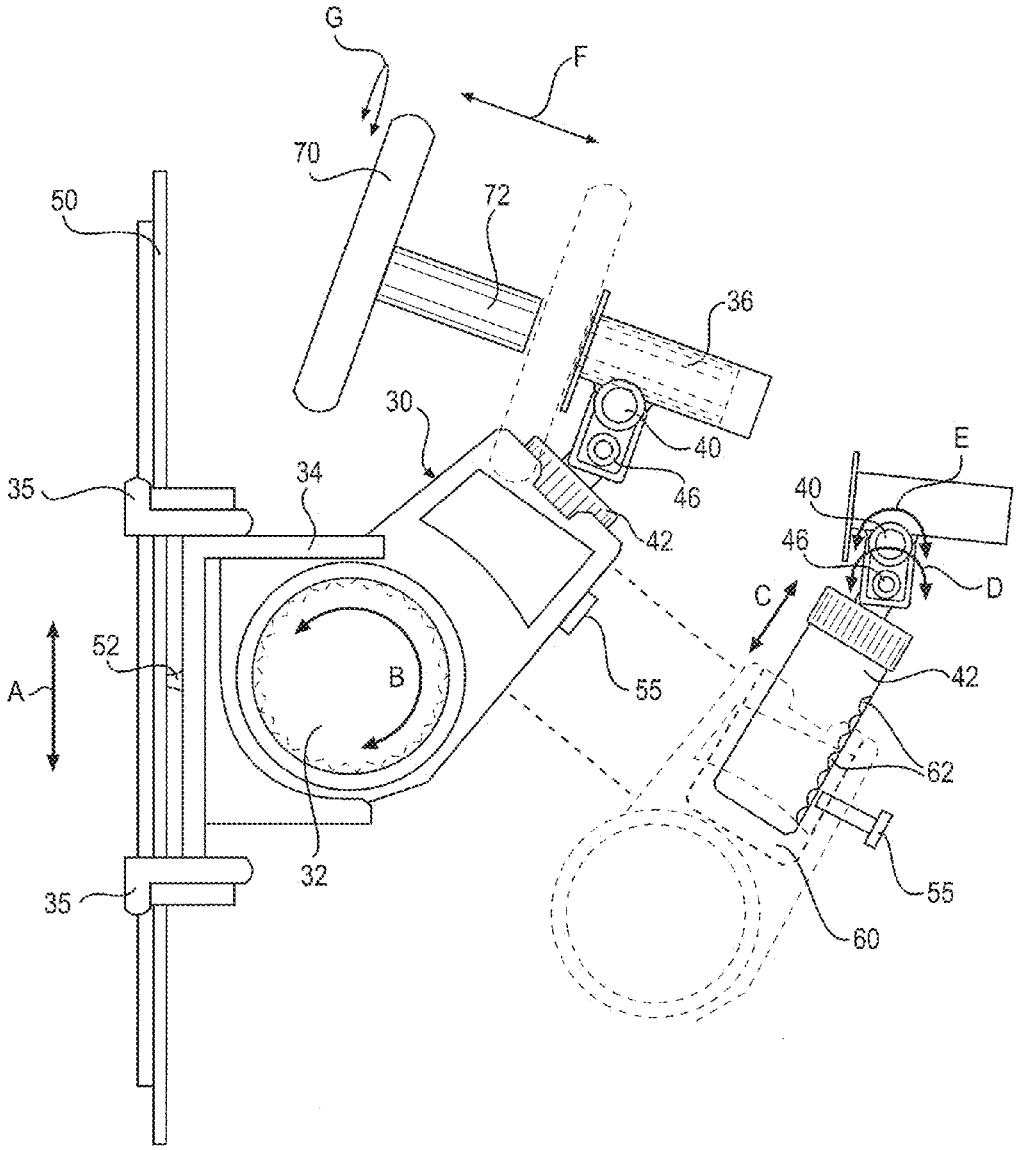
FIG. 2 is a side view of the toy simulator shown in FIG. 1.

Turning specifically to FIG. 2, the carriage 34 onto which is mounted the main spring 32 is slidably engaged to the rack 50 by way of bracket arms 35. FIG. 2 illustrates the insertion of the toy handle 72 and toy wheel 70 into the mount 36. FIG. 2 further illustrates the stem 42 and how it is telescopingly received within the distal end of the action arm 30. The stem 42 includes indents 62 along a longitudinal side thereof. A spring pin 52 allows a user to move the stem 42 in and out of the cavity 60 inside the distal end of the action arm 30.

Figure 3:
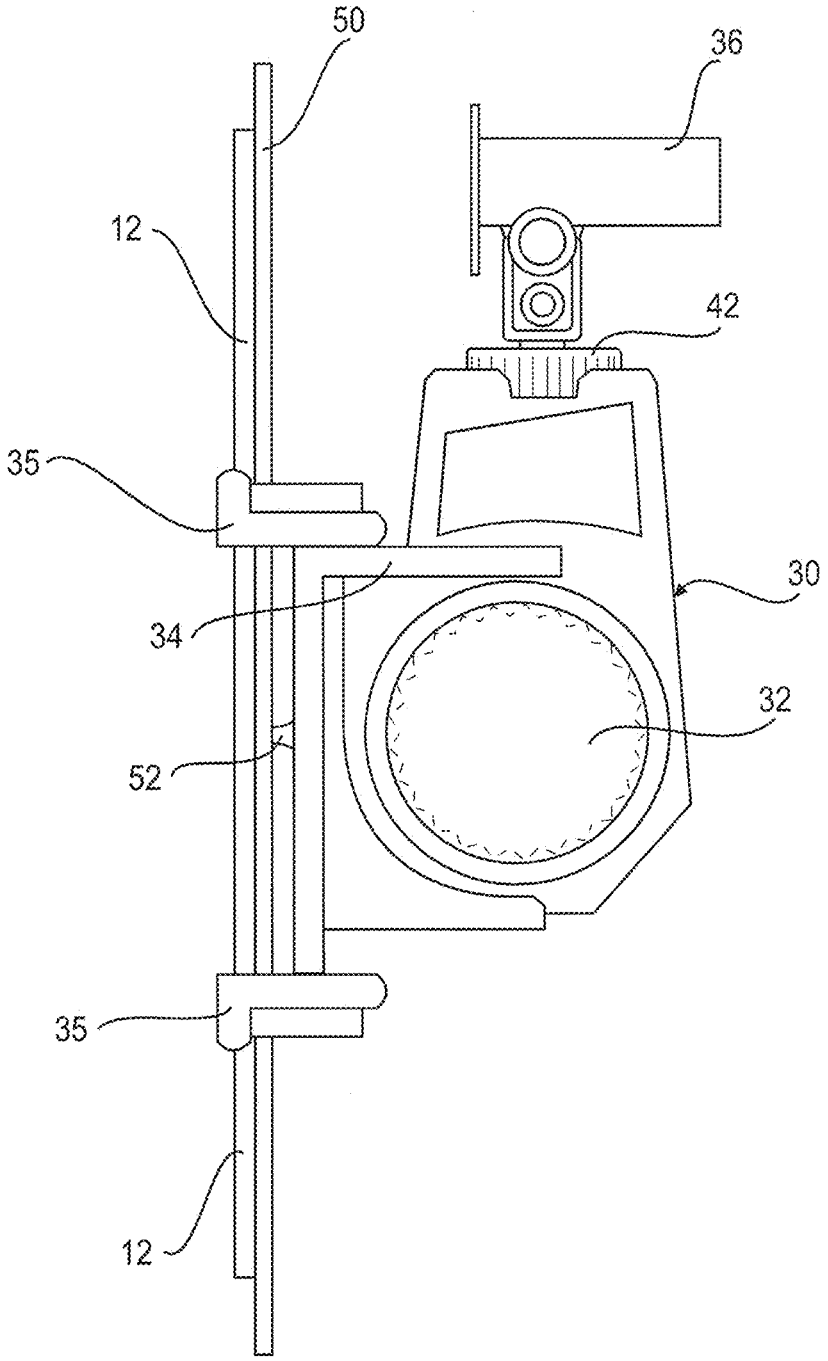
FIG. 3 is another side view of the toy simulator shown in FIG. 1.

FIG. 3 is an alternative illustration of FIG. 2 and shows the action arm 30 in the upright or at rest position with respect to the rack 50.

Figure 4:
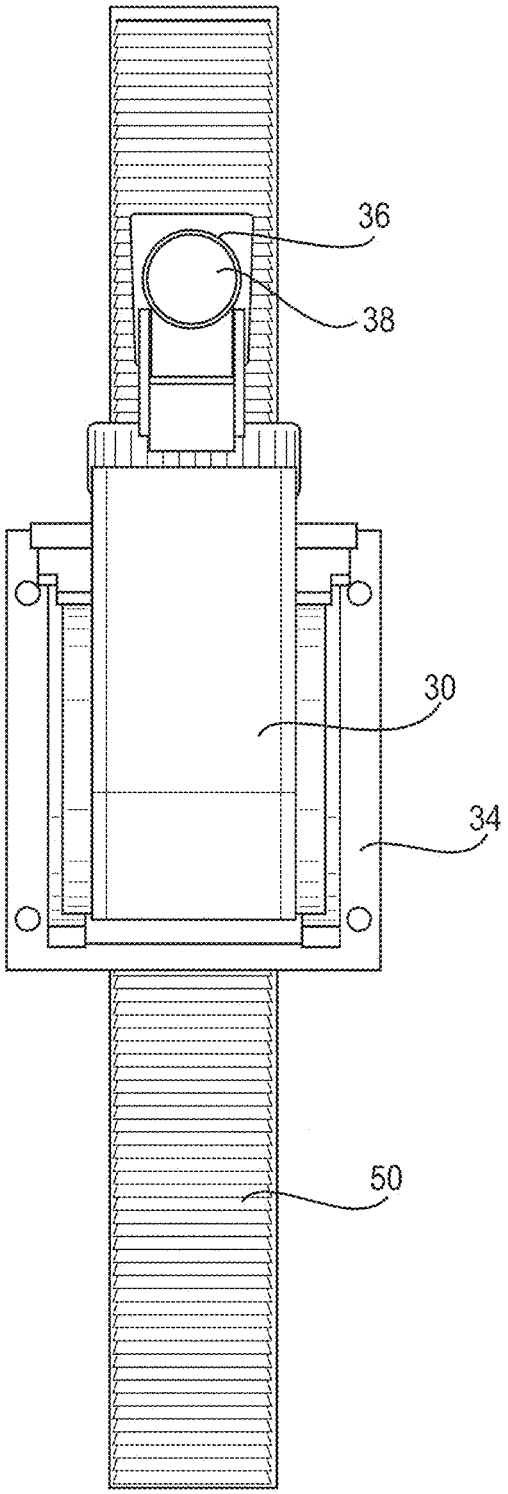
FIG. 4 is a front view of the toy simulator shown in FIG. 1.

FIG. 4 is a front view that illustrates the rack 50 and the carriage 34 mounted thereon. The action arm 30 includes the toy mount 36 and mounting cylinder 38 therein.

Figure 5B:
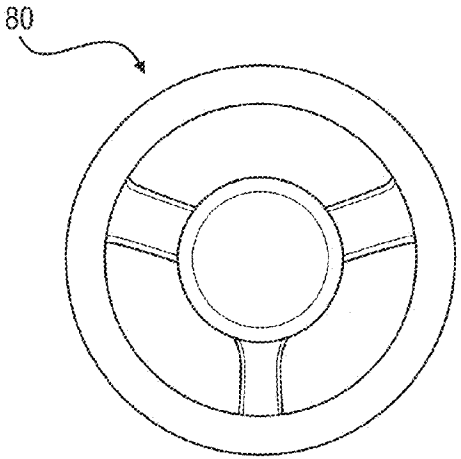
FIGS. 5A-5C are front views of alternative non-limiting examples of toy wheels and an auxiliary electronics mount adaptor that may be used with the toy simulator herein.
Figure 5C:
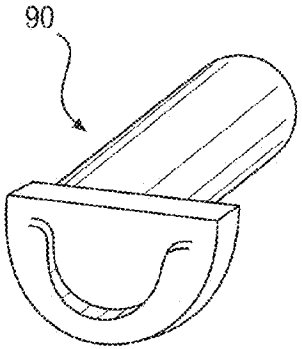
Figure 5A:
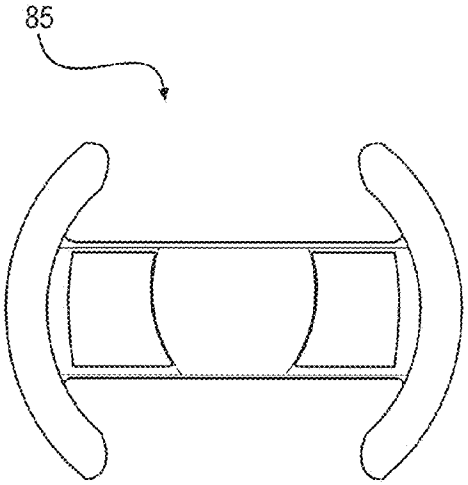

FIGS. 5A and 5B illustrate alternative examples 85 and 80 respectively of toy wheels that might be insertable in the mount 36 of the action arm 30. Alternative designs of wheels or other toy components may be inserted within the mount 36. The examples of 5A and 5B are not limiting in any way of the types of inserts that can be used with the toy simulator. FIG. 5C illustrates a mount adaptor 90 that could be used to carry an electronics device including a smart phone or a tablet. In this way, video games could also be used in conjunction with the wearable toy simulator.

FIG. 2 is also used to illustrate the multiple ranges of motion A-G that are enabled by the example of the toy simulator described herein. First, range of motion A indicates the up and down motion of the carriage 34 on the rack 50 that is enabled by the frictional engagement of the tab 52 on the face of the rack 50. Second, there is rotational range of motion B that is enable by the main spring 32 at the proximal end of the action arm 30. Next, linear range of motion C is enabled by the telescoping in and out movement of the stem 42 within the cavity 60 of the distal end of the action arm 30. In the alternative where bolt 40 acts as a hinge, then bolt 40 and hinge 46 offer additional rotational ranges of motion D and E for the mount 36 on the stem 42. Range of motion F is the linear movement of the handle 72 inside of and out of the cavity 38 in the mount 36. Finally, a range of motion G is the rotational movement of toy wheel or other insert. It is readily apparent that the toy simulator described herein gives many opportunities for imagination and play by a child.

Other embodiments of the present invention will be apparent to those skilled in the art from consideration of the specification. It is intended that the specification and figures be considered as exemplary only, with a true scope and spirit of the invention being indicated by the following claims.

That which is claimed is:

1. A toy simulator comprising:

a harness strap and a semi-rigid base attached to the harness strap, wherein the semi-rigid base is adapted to be disposed in front of a child and above waist level, and the harness strap has an adjustable effective length to encircle the shoulders of the child and retain the base in front of the child;

the semi-rigid base having a rack of a plurality of parallel and horizontal grooves on a front face of the semi-rigid base;

an action arm having a lower, proximal end thereof that is slidably engaged with the semi-rigid base and rack thereon, the proximal end of the action arm further comprising a tab that is biased against the face of the rack and its grooves, wherein the tab is stiff enough to retain the action arm in a vertical location on the rack but flexible enough to allow a child to move the action arm up and down the face of the rack and semi-rigid base.

2. The toy described in claim 1, wherein the action arm further comprises a main spring that enables forward and back rotation of the action arm pivoting around the main spring that is positioned near the proximal end of the action arm, and the axis of rotation of the action arm is substantially parallel to the horizontal grooves on the front face of the rack, and further wherein the main spring is biased to the upright position where the length of the action arm is substantially parallel to the face of the semi-rigid base.

3. The toy described in claim 2, further comprising an interchangeable toy mount that is connected to substantially the distal end of the action arm, wherein the mount comprises a rotatable connector for receiving an interactive toy handle.

4. The toy described in claim 3, wherein the toy mount comprises a stem that is slidably engaged in a sleeve in the distal end of the action arm, and the toy mount is movable into and out from the action arm sleeve generally along a longitudinal axis of the action arm.

5. The toy described in claim 4, wherein the toy handle simulates a vehicle steering wheel.

6. The toy described in claim 4, wherein the toy handle simulates an airplane steering wheel.

7. The toy described in claim 4, wherein the stem and sleeve are frictionally engaged with each other by way of grooves formed in a face of the stem and a ball in spring mechanism in the sleeve bearing against the stem grooves.

8. The toy described in claim 4, wherein the toy mount is rotatably mounted onto the stem, and the axis of rotation of the toy mount is substantially perpendicular to the longitudinal axis of the action arm.

* * * * *